United States Patent [19]

Overley et al.

[11] Patent Number: 4,554,907

[45] Date of Patent: Nov. 26, 1985

[54] LATCH FOR SELF-CLEANING OVEN DOOR

[75] Inventors: Ronald V. Overley, Bloomfield Township, Morrow County; Michael H. Tedhams, Columbus; Carl L. Atzbach, Pleasant Township, Hardin County, all of Ohio

[73] Assignee: Whirlpool Corporation, Benton Harbor, Mich.

[21] Appl. No.: 560,856

[22] Filed: Dec. 12, 1983

[51] Int. Cl.[4] ..... F23M 7/00; E05C 7/00

[52] U.S. Cl. ..... 126/191; 126/197; 292/27; 292/24

[58] Field of Search ..... 126/192, 197; 292/24–56

[56] References Cited

U.S. PATENT DOCUMENTS

| | | | |
|---|---|---|---|
| 1,264,814 | 4/1918 | Kornstein | 292/27 |
| 2,677,262 | 5/1954 | Vigmostad | 292/24 |
| 2,967,418 | 1/1961 | Donald | 292/27 |
| 3,360,290 | 4/1969 | De Gray | 292/6 |
| 3,438,666 | 4/1969 | Erickson | 292/210 |
| 3,582,119 | 6/1971 | Woodworth | 292/27 |
| 3,831,580 | 8/1974 | McLean | 126/197 |
| 4,364,589 | 12/1982 | Watson | 292/113 |

*Primary Examiner*—William E. Lyddane
*Assistant Examiner*—Gerald A. Anderson
*Attorney, Agent, or Firm*—Wood, Dalton, Phillips, Mason & Rowe

[57] ABSTRACT

An improved latching and locking device for use with a door, such as a door of a self-cleaning oven structure, or the like. The latching and locking device utilizes a novel scissors action, avoiding the need for overcenter devices, and providing a smooth releasable latching function while yet providing positive locking of the door when desired, such as during high temperature self-cleaning operations of the oven.

18 Claims, 3 Drawing Figures

LATCH FOR SELF-CLEANING OVEN DOOR

BACKGROUND OF THE INVENTION

1. Field of the Invention

This invention relates to self-cleaning oven structures and in particular to latching and locking means for use with the door of such oven structures.

2. Description of Background Art

In U.S. Pat. No. 3,438,666, Karl H. Erickson discloses a latching mechanism with a temperature-responsive blocking device. The device includes a blocking member which is rotated into blocking relation with a latch to prevent movement of the latch to an unlatched position when a sensed temperature is exceeded.

In U.S. Pat. No. 4,364,589 of Howard E. Watson, which patent is owned by the assignee hereof, structure for locking a latching mechanism is provided for controlling the opening of a range door so as to prevent opening thereof when the oven cavity is at a preselected high temperature.

SUMMARY OF THE INVENTION

The present invention comprehends an improved latching and locking device for maintaining a door, such as a self-cleaning oven door, releasably in the closed position.

In the illustrated embodiment, the latching and locking device includes latch means operative in a scissorlike arrangement to define a pair of selectively positionable latch bolts.

In the illustrated embodiment, the latching and locking device is free of overcenter means in effecting the latching and locking functions.

The improved latching and locking device is advantageously adapted for use in a self-cleaning oven structure having wall means defining an oven cavity and a door movably mounted to the wall means for selectively closing the cavity in a closed disposition thereof.

In the illustrated embodiment, the improved latching and locking device includes a pair of latch arms, pivot means for pivotally mounting the latch arms on the wall means in a scissorlike arrangement to define a pair of selectively pivotable distal latch bolts, means on the door defining an opening having a pair of catches at spaced portions thereof disposed to be engaged by the latch bolts as an incident of the latch arms being projected through the opening while in a closed arrangement and the distal latch bolts being urged apart into juxtaposition with the catches in an opened arrangement, means biasing the latch arms to the closed arrangement, means for urging the latch arms to the opened arrangement as an incident of the projection of the latch means through the opening, the latching and locking device being free of overcenter means, and locking means for locking the latch arms in the opened arrangement as an incident of the oven cavity being heated to a preselected high temperature with the door in the closed position, whereby the door may be effectively releasably latched and locked in the closed position during self-cleaning operation of the oven structure.

In the illustrated embodiment, the biasing means comprises spring means urging the latch arms to the closed arrangement.

The biasing means, in the illustrated embodiment, further includes cooperating spring and camming means urging the latch arms to the opened arrangement.

In the illustrated embodiment, at least one latch arm includes a shoulder portion selectively cooperating with the locking means to prevent movement of the latch arms from the opened arrangement as an incident of the oven cavity being heated to a preselected high temperature, with the door in the closed position.

In the illustrated embodiment, the latching and locking means includes camming means for causing the latch arms to move from the opened arrangement to space the latch bolts from the catches as an incident of urging the door from the closed position when the oven cavity is at a temperature less than the preselected high temperature.

The improved latching and locking device of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
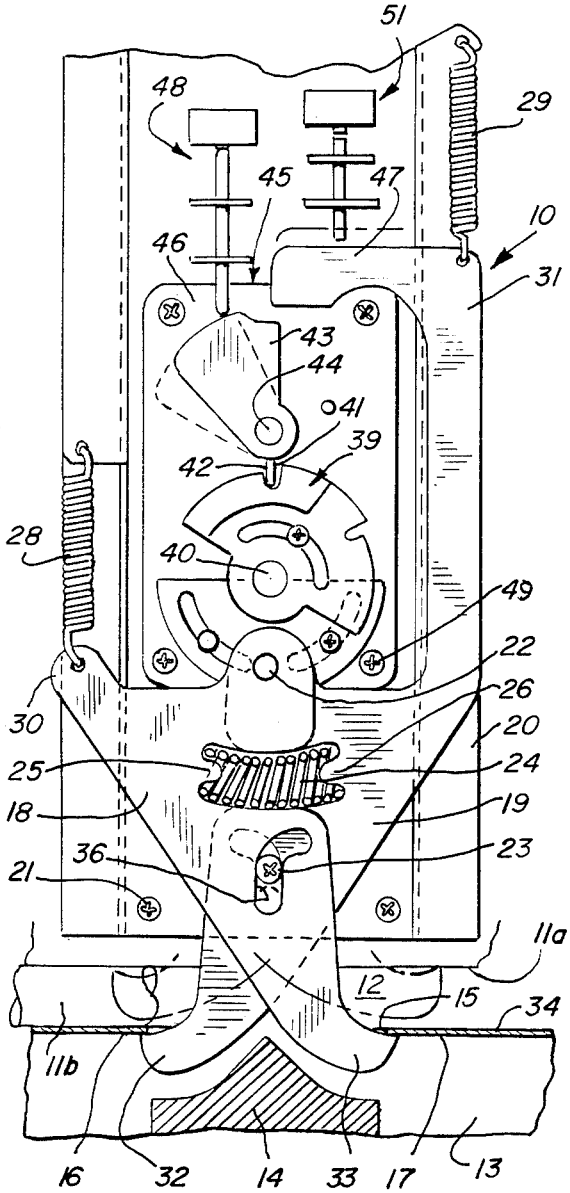
FIG. 1 is a fragmentary front elevation of the latching and locking device embodying the invention.

In the illustrative embodiment of the invention as disclosed in the drawing, a latching and locking device generally designated 10 is adapted for installation in a self-cleaning oven structure generally designated 11 having a front face 11*a* and defining an oven cavity 12 selectively closed by a door 13. A gasket 11*b* is provided to seal the space between the door 13 and front face 11*a* when the door is closed.

Door 13 is provided with strike means 14 inwardly adjacent an opening 15 in an inner door wall 34 defined by sidewall portions 16 and 17 forming catches selectively cooperating with a pair of latch arms 18 and 19 pivotally mounted to a mounting plate 20 adapted to be secured to an oven wall or an oven cabinet (not shown) by suitable means, such as screws 21.

More specifically, the latch arms 18 and 19 are pivotally interconnected by a pivot pin 22 and are translatable on the mounting plate 20 as a result of relative movement between a guide pin 23 mounted to the plate 20, and a pair of overlapped, divergent kidney-shaped slots 36 in latch arm 18 and 37 in latch arm 19 through which slots the pin 23 extends as seen in FIG. 1. The arms are biased in opposite directions about pivot pin 22 by a compression spring 24, defining a biasing means having its opposite ends engaged with spring retainer portions 25 and 26 of arms 18 and 19, respectively.

The pair of arms 18 and 19, defining latch bolts are urged to be translated away from door 13 by a first tension spring 28 and a second tension spring 29 connected between a connecting portion 30 on latch arm 18 and a connecting portion 31 on latch arm 19, respectively.

Figure 3:
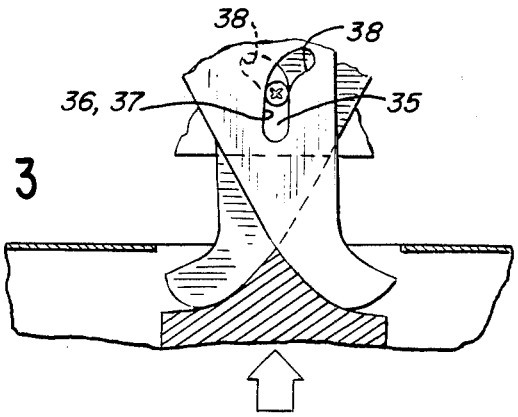
FIG. 3 is a fragmentary elevation illustrating the movement of the latch arms toward the latching position as a result of the camming of the arms thereto by the door strike.

When device 10 is in the door latching position of FIG. 1, the outturned distal end portions 32 and 33, defining latch bolts are retained behind the catch portions 16 and 17 of the door wall 34. They are maintained in the latching, open arrangement of the scissorlike configuration of the latch arms by the springs 28 and 29 urging the latch arms inwardly to cause the pin 23 to be disposed in the outer portion 35 of the slots 36 and 37, respectively (FIG. 3). The pin 23 does not reach an end 35*a* of the slots 36 and 37, so that there is provided a sealing force by springs 28 and 29 holding the door face 34 against the gasket 11*b*.

Figure 2:
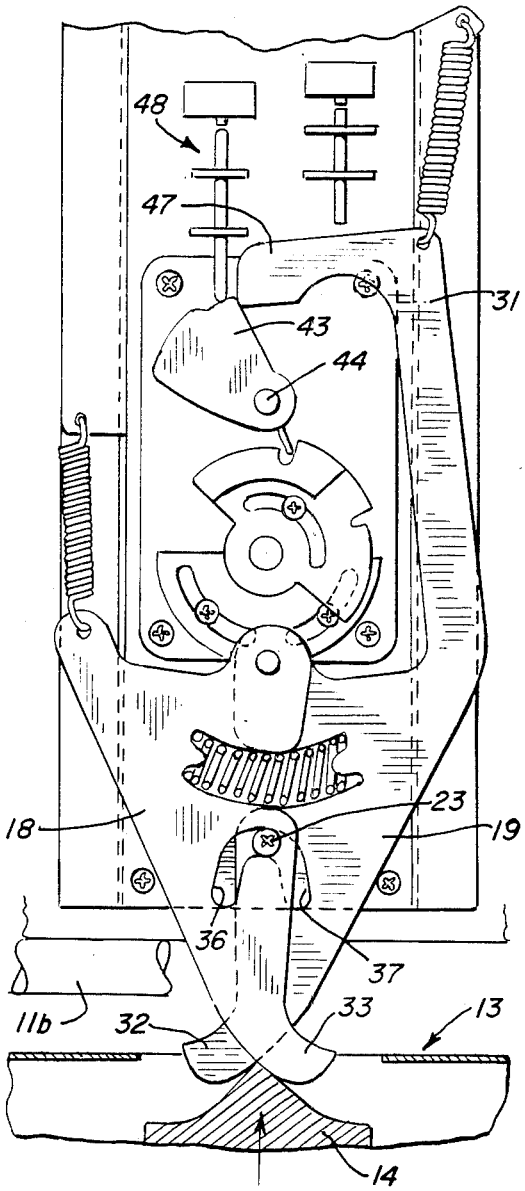
FIG. 2 is a fragmentary front elevation thereof similar to that of FIG. 1 but with the device in the released, closed arrangement.

When the door 13 is moved from the closed position of FIG. 1, the catch portions 16 and 17 of door wall 34 urge the latch arms against the action of springs 28 and 29 so as to cause pin 23 to move inwardly toward the turned end 38 of the slots 36 and 37 (FIG. 3) and permit the spring 24, in cooperation with springs 28 and 29, to pivot the latch arms 18 and 19 about pivot pin 22 to the closed scissor arrangement of FIG. 2, wherein the latch bolt portions 32 and 33 are released from the catch portions 16 and 17 of the door wall 34, releasing the door for access to the oven cavity 12.

Reversely, as illustrated in FIG. 2, when the door is brought back to the closed disposition, strike 14 tends to separate the latch arm portions 32 and 33 while at the same time urging the latch arms inwardly so as to cause pin 23 to move out of the turned ends 38 of the slots 36 and 37 back to the arrangement of FIG. 1 wherein the latch bolt portions 32 and 33 are caused to latch behind the catch portions 16 and 17 of the door wall 34.

Thus, the door is effectively secured in the latching disposition without the use of overcenter means, providing a smooth latching function which effectively positively retains the door releasably in closed disposition during normal use of the oven.

As discussed briefly above, the invention further comprehends the provision of means in the latching and locking device 10 for effectively locking the device in the door latching position of FIG. 1 such as during high temperature conditions within oven cavity 12 as occur during a high temperature self-cleaning cycle. During such cleaning cycles, the temperature in the oven cavity rises above 575° F., making it dangerous to permit the door to be opened by the user at that time. To prevent opening of the door from the position of FIG. 1, device 10 further includes a temperature-responsive control device 39, defining a temperature sensor, rotatably mounted to plate 20 on a pivot 40. Device 39 defines a selectively positionable recess 41 receiving a projection 42 on a stop 43 pivotally mounted to plate 20 by a pivot 44. In the illustrated embodiment, the locking structure generally designated 45 includes an auxiliary mounting plate 46 secured to the mounting plate 20 by suitable screws 49 and directly mounting the control device 39 and stop 43.

At low temperature conditions, stop 43 is pivoted clockwise on pivot 44 to the released disposition of FIG. 2, permitting the distal end 47 of latch arm 19 to be freely movable between the open and closed positions of FIGS. 1 and 2.

However, when the door is in the closed disposition of FIG. 1 and the high temperature self-cleaning cycle is initiated to raise the temperature in the oven cavity to above a preselected temperature, such as 575° F., control 39 rotates in a counterclockwise direction carrying projection 42 with it so as to dispose the stop 43 in the path of movement of the arm portion 47 preventing pivotal movement of the latch arm 19 from the closed disposition of FIG. 1, thereby effectively locking the door in the latched disposition of FIG. 1.

Upon cooling of the oven cavity to below the preselected temperature as upon completion of the self-cleaning cycle, control 39 rotates in a clockwise direction to the position of FIG. 2 removing stop 43 from interference with latch arm portion 47 and thereby permitting the door to be opened in the manner discussed above.

A conventional safety switch device 48 may be provided cooperating with stop 43 so as to prevent effecting of the high temperature self-cleaning cycle unless the door 13 is in the closed disposition.

As a further added safety means, a second safety switch 51 is provided. As shown in FIGS. 1 and 3, due to the sealing force provided between the door 13 and gasket 11*a*, the pin 23 is not disposed at the end 35*a* of slots 36 and 37. Should the latch arms 18 and 19 be manually forced together and pushed inwardly, the arms will move in further than when latched to the door, and pin 23 will be disposed at end 35*a* of slots 36 and 37. Latch arm portion 47 will thus move inwardly to actuate switch 51, preventing effecting of the high temperature self-cleaning cycle because the door is not properly closed.

Thus, the improved latching and locking device of the present invention is free of overcenter means and utilizes a pair of latch arms disposed in a scissorlike arrangement for selectively latching the oven door closed and locking the oven door in the closed disposition under certain high temperature conditions. The latching and locking function is carried out without the need of overcenter means, thereby permitting smooth transition between the different arrangements of the latching and locking means. Device 10 is adapted for use with conventional high temperature sensors for effecting the automatic locking function by the addition of a simple and economical stop means responsive to the positioning of the high temperature sensor.

The foregoing disclosure of specific embodiments is illustrative of the broad inventive concepts comprehended by the invention.

We claim:

1. In a self-cleaning oven structure having wall means defining an oven cavity and a door movably mounted to said wall means for selectively closing said cavity in a closed position thereof, an improved latching and locking device for maintaining the door releasably in said closed position, comprising:

a pair of latch arms each having a distal portion, and defining overlapping, divergent kidney-shaped slots;

pivot means for pivotally mounting said latch arms on said wall means in a scissorlike arrangement, said distal portions of the latch arms defining a pair of selectively positionable latch bolts;

means on said door defining an opening having a pair of catches at spaced portions thereof disposed to be engaged by said latch bolts as an incident of said latch arms being projected through said opening while in a closed arrangement and said latch bolts being urged apart into juxtaposition with said catches in an opened arrangement;

means biasing said latch arms to said closed arrangement;

means including a guide pin on said wall means extending through said overlapping slots and means on the door for urging said latch arms to said opened arrangement as a result of the projection of said latch arms through said opening, said latching and locking device being free of overcenter means; and locking means for locking said latch arms in said opened arrangement in engagement with said catches to define means for mounting the door in said closed position as an incident of said oven cavity being heated to a preselected high temperature with said door in said closed position, whereby said door may be effectively releasably latched and locked in said closed position during operation of the oven structure.

2. The self-cleaning oven structure of claim 1 wherein said biasing means comprises spring means urging said latch arms to said closed arrangement.

3. The self-cleaning oven structure of claim 1 wherein said means for urging said latch arms to said opened arrangement comprises cooperating spring and camming means.

4. The self-cleaning oven structure of claim 1 wherein said biasing means comprises first spring means urging said latch arms to said closed arrangement, and said means for urging said latch arms to said opened arrangement comprises cooperating second spring and camming means.

5. The self-cleaning oven structure of claim 1 wherein at least one latch arm includes a shoulder portion selectively cooperating with said locking means to prevent movement of said latch arms from said opened arrangement as an incident of said oven cavity being heated to a preselected high temperature with said door in said closed position.

6. The self-cleaning oven structure of claim 1 wherein said latching and locking device includes a mounting plate mounted to said door.

7. In a self-cleaning oven structure having wall means defining an oven cavity and a door movably mounted to said wall means for selectively closing said cavity in a closed position thereof, an improved latching and locking device for maintaining the door releasably in said closed position, comprising:

a pair of latch arms each having a distal portion;

pivot means for pivotally mounting said latch arms on said wall means in a scissorlike arrangement to define a pair of selectively positionable latch bolts;

means on said door defining an opening having a pair of catches at spaced portions thereof disposed to be engaged by said latch bolts as an incident of said latch arms being projected through said opening while in a closed arrangement and said distal latch bolts being urged apart into juxataposition with said catches in an opened arrangement;

means including guide means carried by the wall means and cooperating with the latch arms and strike means carried by the door for urging said latch arms to said opened arrangement as a result of the projection of said latch arms through said opening to beyond the catches, said latching and locking device being free of over center means;

locking means for locking said latch arms in said opened arrangement in engagement with said catches to define means for mounting the door in said closed position as an incident of said oven cavity being heated to a preselected high temperature with said door in said closed position, whereby said door may be effectively latched and locked in said closed position during self-cleaning operation of the oven structure; and camming means for causing said latch arms to move from said opened arrangement to space said latch bolts from said catches as an incident of urging of the door from said closed position when said oven cavity is at a temperature less than said preselected high temperature.

8. The self-cleaning oven structure of claim 7 wherein said latching and locking device includes a mounting plate mounted to said cavity and said camming means includes a cam element mounted to said mounting plate.

9. The self-cleaning oven structure of claim 7 wherein said latching and locking device includes a mounting plate mounted to said door and said camming means includes a cam follower mounted to said mounting plate and means defining a cam surface for cooperation with said cam follower on at least one of said latch arms.

10. The self-cleaning oven structure of claim 7 wherein said latching and locking device includes a mounting plate mounted to said cavity and said camming means includes a cam follower mounted to said mounting plate and means defining a cam surface for cooperation with said cam follower at each of said latch arms.

11. The self-cleaning oven structure of claim 7 wherein said latching and locking device includes a mounting plate mounted to said cavity and said camming means includes a cam follower mounted to said mounting plate and a kidney-shaped slot defining a cam surface for cooperation with said cam follower on at least one of said latch means.

12. The self-cleaning oven structure of claim 7 wherein said latching and locking device includes a mounting plate mounted to said cavity, said camming means inlcudes a cam follower mounted to said mounting plate and a kidney-shaped slot defining a cam surface for cooperation with said cam follower on at least one of said latch means, and means for biasing said latch arms to a disposition wherein the camming means causes said latch arms to be in said closed arrangement.

13. In a self-cleaning oven structure having wall means defining an oven cavity and a door movably mounted to said wall means for selectively closing said cavity in a closed position thereof, an improved latching and locking device for maintaining the door in said closed position, comprising:

a pair of latch arms each having distal portions;

pivot means for pivotally mounting said latch arms on said door in a scissorlike arrangement, said distal portions of the latch arms defining a pair of selectively positionable latch bolts;

means on said door defining strike means and an opening having a pair of catches at spaced portions thereof disposed to be engaged by said latch bolts as a result of said latch arms being projected through said opening while in a closed arrangement and said distal latch bolts being urged apart into juxtaposition with said catches in an opened arrangement;

biasing means for biasing said latch arms to said closed arrangement;

means for urgining said latch arms to said opened arrangement as a result of the projection of said latch arms through said opening to beyond the catches, said latching and locking device being free of overcenter means;

camming means for causing said latch arms to move from said opened arrangement to space said latch bolts from said catches as a result of urging of the door from said closed position when said oven cavity is at a temperature less than said preselected high temperature; and locking means for locking said latch arms in said opened arrangement as an incident of said oven cavity being heated to a preselected high temperature with said door in said closed position, whereby said door may be effectively latched and locked in said closed position during self-cleaning operation of the oven structure.

14. The self-cleaning oven structure of claim 13 wherein said biasing means comprises spring means urging said latch arms to said closed arrangement.

15. The self-cleaning oven structure of claim 13 wherein said means for urging said latch arms to said opened arrangement comprises cooperating spring and camming means.

16. The self-cleaning oven structure of claim 13 wherein said locking means comprises a rotary temperature sensor device and a stop element selectively positioned by said sensor device.

17. The self-cleaning oven structure of claim 13 wherein said locking means comprises a rotary temperature sensor device and a stop element selectively positioned by said sensor device to interfere with movement of one of said latch arms as an incident of the sensing of said high temperature with the door in the closed position.

18. The self-cleaning oven structure of claim 13 wherein said locking means comprises a rotary temperature sensor device and a pivotally mounted stop element selectively positioned by said sensor device.

* * * * *